United States Patent [19]

Monroe

[11] 4,412,717

[45] Nov. 1, 1983

[54] COAXIAL CONNECTOR PLUG

[75] Inventor: Kevin T. Monroe, Harrisburg, Pa.

[73] Assignee: AMP Incorporated, Harrisburg, Pa.

[21] Appl. No.: 390,427

[22] Filed: Jun. 21, 1982

[51] Int. Cl.[3] ..... H01R 13/62; H01R 17/18

[52] U.S. Cl. ..... 339/177 R; 399/258 R

[58] Field of Search ..... 339/177 R, 177 E, 91 P, 339/94 C, 126 J, 258 R, 258 A, 276 T

[56] References Cited

U.S. PATENT DOCUMENTS

| | | | |
|---|---|---|---|
| 2,238,834 | 4/1941 | Travers | 339/177 E |
| 3,206,540 | 9/1965 | Cohen | 339/89 C |
| 3,384,703 | 5/1968 | Forney et al. | 339/94 C |
| 3,406,376 | 10/1968 | Varrin | 339/258 |
| 3,745,514 | 7/1973 | Brishka | 339/91 R |
| 3,871,735 | 3/1975 | Herrmann, Jr. | 339/177 R |
| 4,165,911 | 8/1979 | Laudig | 339/177 E |
| 4,377,320 | 3/1983 | Lathrop et al. | 339/177 R |

FOREIGN PATENT DOCUMENTS

| | | | |
|---|---|---|---|
| 21459 | 11/1956 | Fed. Rep. of Germany | 339/177 E |
| 1157274 | 5/1958 | France | 339/177 E |
| 1480724 | 7/1977 | United Kingdom | 339/258 R |

*Primary Examiner*—John McQuade
*Assistant Examiner*—Paula Austin
*Attorney, Agent, or Firm*—Adrian J. LaRue

[57] ABSTRACT

A coaxial connector comprises a dielectric spacer captured in an inner shell. A forward part of the inner shell is secured within a tubular section of a spring contact member with leaf spring contact members having contact sections extending axially along and spaced from a forward part of the dielectric spacer and bent back sections extending along the contact sections. An outer shell has a rear section crimpably secured onto the tubular section of the spring contact member and a forward section extending along the leaf spring contact members with the forward end being rolled in to serve as an entrance to the connector. A center contact is crimpable onto a center conductor of a stripped end of a coaxial cable, the crimped center contact is inserted into the dielectric spacer, and an outer conductor of the coaxial cable is crimped onto the inner shell.

5 Claims, 7 Drawing Figures

COAXIAL CONNECTOR PLUG

FIELD OF THE INVENTION

This invention relates to electrical connectors and more particularly to coaxial connectors of the plug type.

BACKGROUND OF THE INVENTION

U.S. patent application Ser. No. 210,694 now U.S. Pat. No. 4,377,320 filed Nov. 26, 1980 discloses a coaxial connector of the SMB type. This connector was found to be difficult to assemble and to terminate for the reasons that the tolerances were difficult to maintain between a stamped and formed spring contact member and a drawn shell member so that when they were assembled together with a dielectric spacer in the spring contact member, these parts would in many cases not remain assembled and would therefore cause terminations not to be easily made when the center contact terminated to the center conductor of a coaxial cable was inserted within the dielectric spacer.

SUMMARY OF THE INVENTION

According to the present invention, a coaxial connector comprises a dielectric spacer captured in an inner shell. A forward part of the inner shell is secured within a tubular section of a spring contact member with leaf spring contact members having contact sections extending axially along and spaced from a forward part of the dielectric spacer and bent back sections extending along the contact sections. An outer shell has a rear section crimpably secured onto the tubular section of the spring contact member and a forward section extending along the leaf spring contact members with the forward end being rolled in to serve as an entrance to the connector. A center contact is crimpable onto a center conductor of a stripped end of a coaxial cable, the crimped center contact is inserted into the dielectric spacer, and an outer conductor of the coaxial cable is crimped onto the inner shell.

DETAILED DESCRIPTION OF PREFERRED EMBODIMENTS

Figure 1:
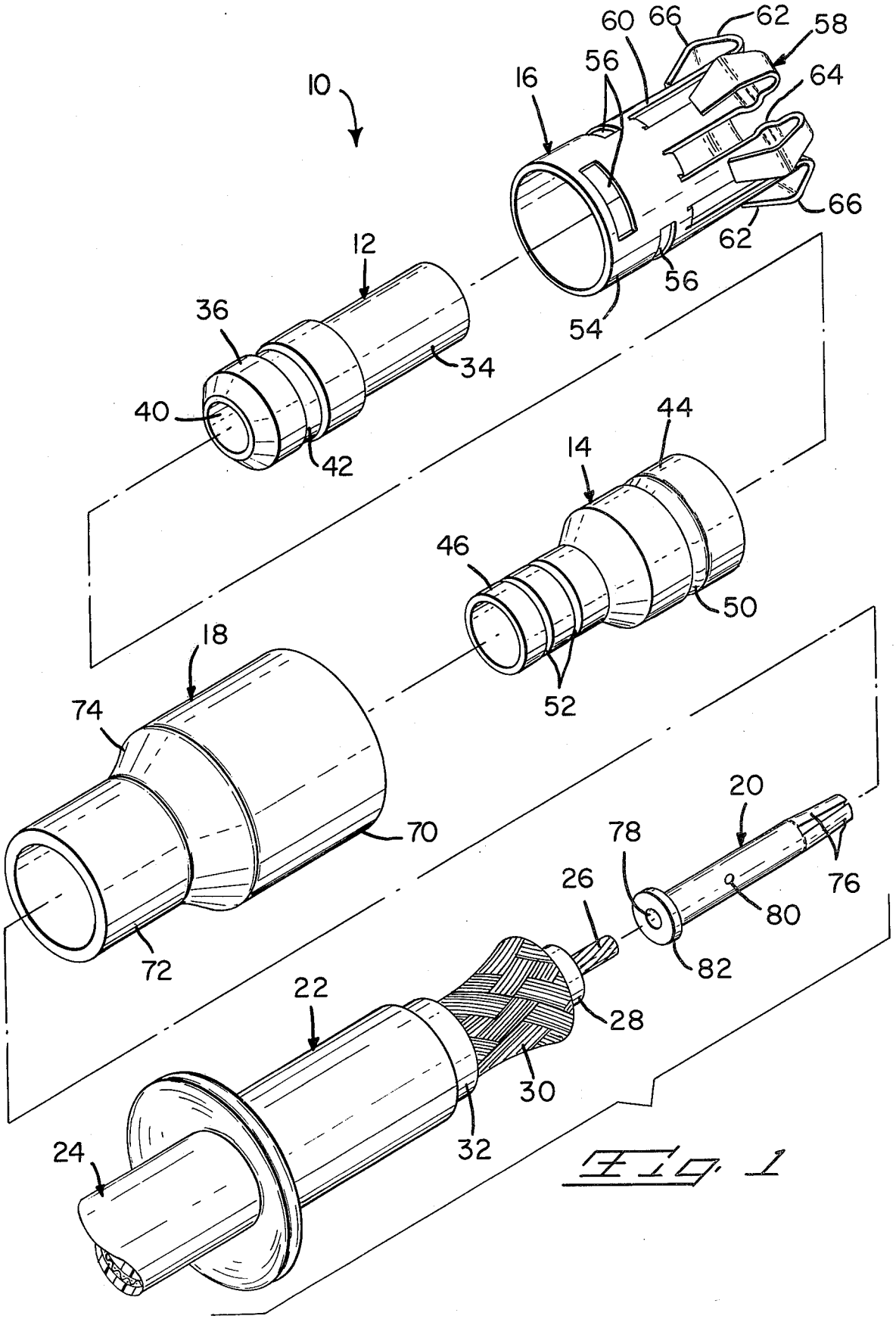
FIG. 1 is an exploded view of the parts of the coaxial connector plug of the present invention.

Referring to FIGS. 1 through 4, the invention comprises a coaxial connector 10 in the form of a plug including a dielectric spacer 12, an inner shell 14, a spring contact member 16, an outer shell 18, a center electrical contact 20, and a crimping ferrule 22. The plug is intended for termination onto a coaxial transmission cable 24 comprising a center conductor 26, surrounded by a dielectric layer 28, which in turn is surrounded by an outer conductive shield 30 and an outer insulative sheath 32.

Dielectric spacer 12 is molded from a suitable dielectric material and has a generally elongate configuration that unitarily includes a forward cylindrical section 34 and a rear cylindrical section 36. An axial bore 38 extends through spacer 12 and is in communication with annular recess 40 in section 36. Annular recess 42 is located in the exterior surface of section 36. The end surface of section 36 is beveled.

Inner shell 14 is of a unitary draw construction and includes large diameter section 44 and small diameter section 46. A beveled transition section 48 connects sections 44 and 46 together. An inwardly-directed annular projection 50 is located in section 44 and annular grooves 52 are located in the exterior surface of section 46. Shell 14 is formed from brass or suitable metal and is bright nickel plated.

Spring contact member 16 is stamped and formed in accordance with common practice from beryllium copper or a metal having suitable spring characteristics. It is nickel plated and has a tubular section 54 in which rectangular openings 56 are located. A plurality of spring contacts 58 are annularly spaced about the forward end of section 54 and extend forwardly therefrom. Each spring contact 58 includes an inner leaf spring 60 and outer leaf spring 62 which is bent back and extends along leaf spring 60 in V-shape configuration. Leaf springs 60 have arcuate projections 64 adjacent outer ends thereof. Leaf springs 62 have increasing width from their jointure with leaf springs 60 to just after their bights 66. The outside surfaces of arcuate projections 64 and bights 66 are gold plated. Inwardly-directed lugs 68 are located between leaf springs 60.

Outer shell 18 is a drawn part from brass or like material and includes a large diameter section 70, small diameter section 72 interconnected together by beveled section 74.

Center electrical contact 20 is formed from beryllium copper or like metal as a tubular member which is gold plated and includes arcuate spring contact members 76, bore 78, sight hole 80, and annular flange 82.

Crimping ferrule 22 is formed from copper or like material as a tubular member which is tin plated and has a beveled flange 84 which terminates as a curved end.

In assembly, section 36 of dielectric spacer 12 is inserted into section 44 of inner shell 14 with the end beveled surface of section 36 engaging beveled section 48 and annular projection 50 engaging annular recess 42 thereby securing spacer 12 and shell 14 together. This assembly is inserted into tubular section 54 of spring contact member 16 until the front end of section 44 engages lugs 68.

Figure 4:
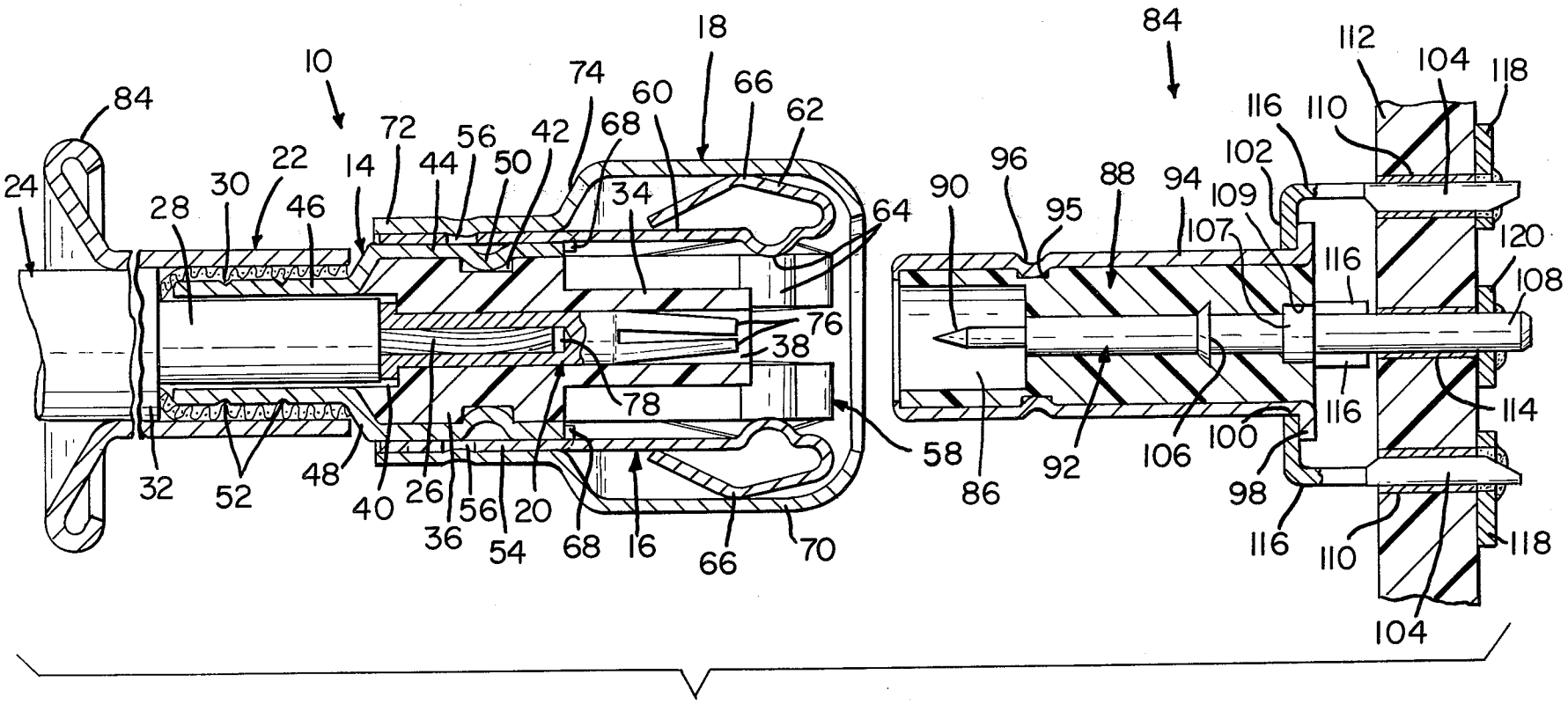
FIG. 4 is a cross-sectional view of the coaxial connector plug terminated onto the coaxial cable and the mating jack exploded therefrom.

Outer shell 18 is positioned onto spring contact member 16 with small diameter section 72 engaging tubular section 54 and large diameter section 70 extending along spring contacts 58. Crimping action is applied to section 72 in accordance with conventional crimping practices thereby crimping section 72 onto section 54 which also causes flow of metal of section 72 into openings 56. The front end of section 70 is rolled inwardly forming an entrance into plug coaxial connector 10 as shown in FIG. 4 and protecting the leaf spring contact members. These assembled parts of the coaxial connector are ready for termination onto a coaxial cable.

Figure 2:
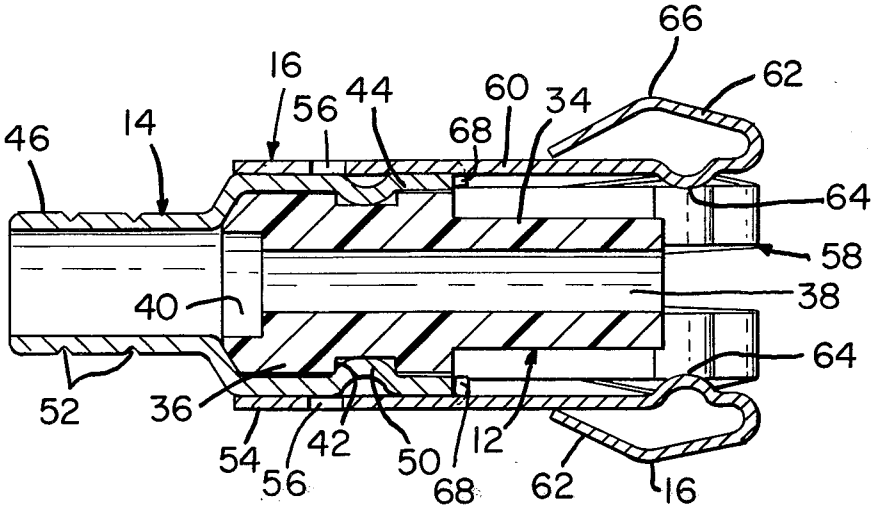
FIG. 2 is a cross-sectional view of a dielectric spacer affixed to the inner shell and these assembled parts inserted into the spring contact member.
Figure 3:
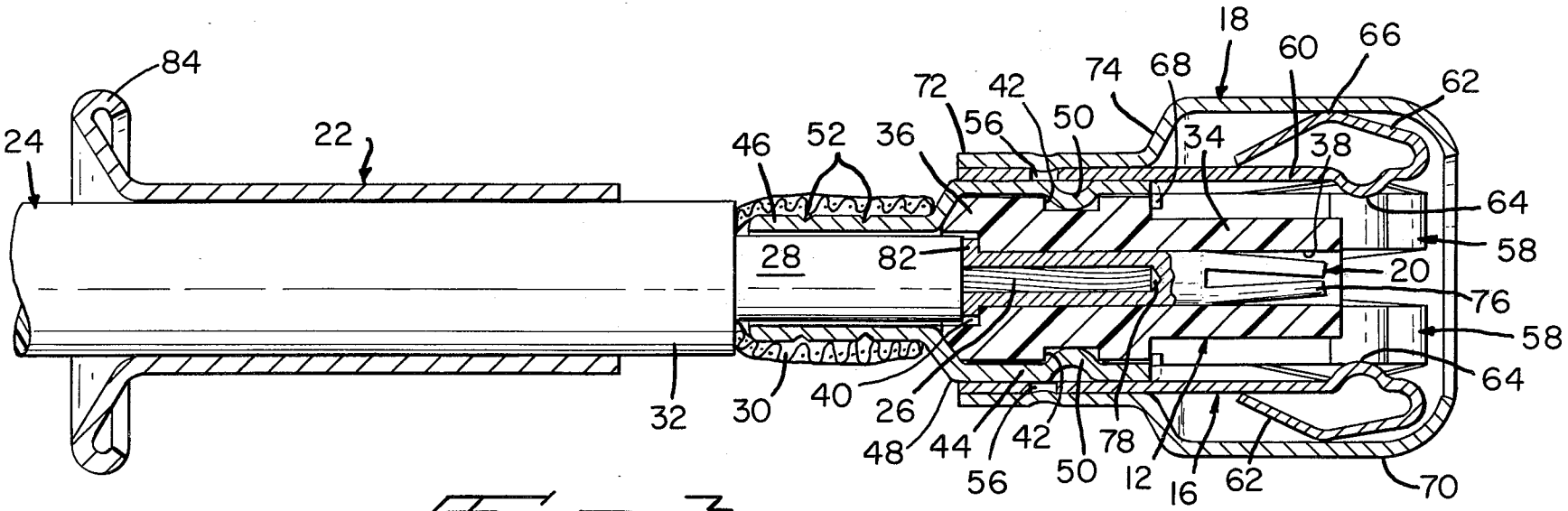
FIG. 3 is a cross-sectional view of the assembly of FIG. 2 crimpably secured in the outer shell and the center contact terminated on the center conductor of the coaxial cable.

To terminate coaxial connector 10 onto a stripped end of coaxial cable 24, crimping ferrule 22 is placed onto sheath 32, center conductor 26 is inserted into bore 78 of center contact 20 with flange 82 engaging dielectric layer 28 whereafter center contact 20 is crimped onto center conductor 26. Terminated center contact 20 is inserted into bore 38 of dielectric spacer 12 of the assembled connector with flange 82 being disposed in annular recess 40, dielectric layer 28 extends along the inner surface of section 46 of inner shell 14, and outer shield 30 is positioned onto the outer surface of section 46. Crimping ferrule 22 is positioned against beveled section 48 of inner shell 14 and a conventional crimping tool (not shown) crimps ferrule 22 onto shield 30 and sheath 32 thereby terminating coaxial connector 10 onto the inner and outer conductors of coaxial cable 24 as shown in FIG. 2.

Connector 10 is electrically connected to coaxial jack 84 as shown in FIG. 4 with section 34 of dielectric spacer 12 positioned within recessed area 86 of dielectric member 88 and spring contact members 76 of center contact 20 electrically connected with center contact pin 90 of center contact member 92 secured in dielectric member 88. Outer contact member 94 of jack 84 is disposed in the space between section 34 of spacer 12 and leaf springs 60 of spring contacts 58 with arcuate projections 64 engaging annular recess 96 of outer contact member 94. The beveled leading edge of members 94 and the arcuate configurations of projections 64 enable plug 10 to be easily connected with jack 84. The spring forces of leaf springs 60 coupled with the spring forces of leaf springs 62 being enhanced by bights 66 engaging section 70 of outer shell 18 provide ease of mating engagement between plug and jack as well as optimum retention and excellent electrical connection.

Figures 5, 6, 7:
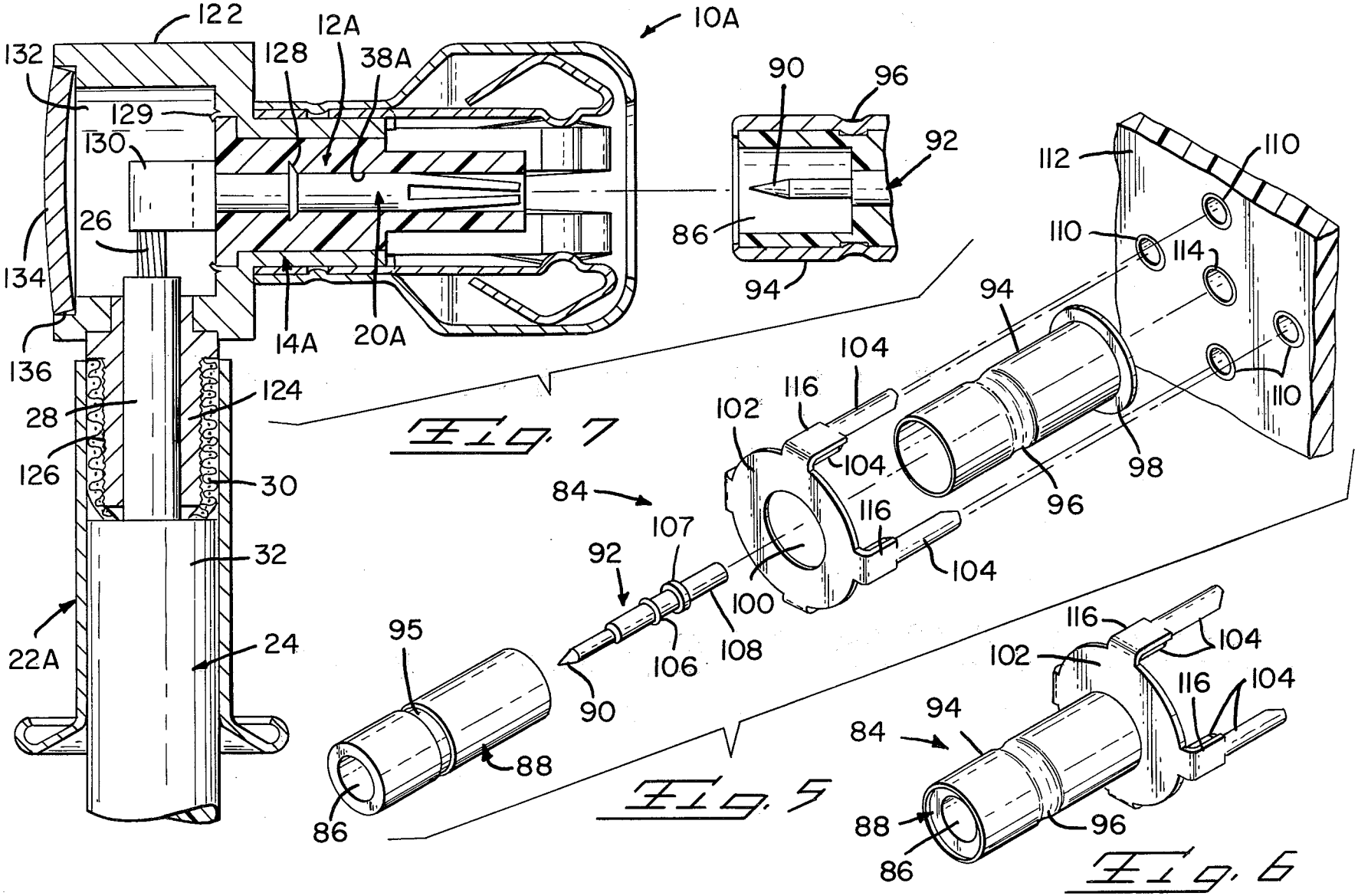
FIG. 5 is an exploded perspective view of the parts of the coaxial jack.
FIG. 6 is a perspective view of FIG. 5 in an assembled condition.
FIG. 7 is a cross-sectional view of a right angle coaxial connector plug and coaxial jack exploded therefrom.

Jack 84 can take the form illustrated in FIGS. 4 through 6. Outer conductor 94 is a drawn tubular member with a flange 98 and annular projection 96. Outer conductor 94 is inserted through opening 100 of a stamped and formed contact member 102 containing U-shaped contacts 104 having pointed ends. Flange 98 is soldered to contact member 102 and center contact member 92 is secured in bore 87 of dielectric member 88 via barb 106 and annular projection 107 in annular recess 109 so that center contact pin 90 is positioned within recessed area 86 of member 88 and center pin member 108 is positioned centrally of contacts 104 when dielectric member 88 is secured in outer conductor 94. Dielectric 88 is secured in outer conductor 94 via annular recess 95 engaging annular projection 96.

Contacts 104 are easily inserted into holes 110 in a printed circuit board 112 with the aid of pointed ends of the contacts while center pin member 108 is inserted in hole 114. Flat sections 116 serve to position jack 84 relative to board 112. Contacts 104 and member 108 are soldered respectively to ground plane 118 and signal conductor 120 with the U-shaped configurations of contacts 104 enabling the solder to wick up into engagement with the ground plane.

FIG. 7 illustrates an alternative embodiment of the plug coaxial connector 10A which is substantially identical to that of plug coaxial connector 10 except that connector 10A is a right angle coaxial connector and inner shell 14A has an annular section 122 from which depends integral ferrule 124 having knurls 126 in its external surface. Dielectric spacer 12A has center electrical contact 20A secured in bore 38A by barb 128 and clinched section 129. Ferrule section 130 of contact 20A is located in bore 132 of section 122 and receives center conductor 26 of coaxial cable 24 therein when dielectric layer 28 is positioned in ferrule 124 and conductive shield 30 is positioned onto the external surface of ferrule 124. Crimping ferrule 22A is crimped onto ferrule 124, shield 30, and sheath 32, and ferrule section 130 is crimped onto center conductor 26 in accordance with the disclosure of U.S. patent application Ser. No. 364,101 filed Mar. 31, 1982, which is incorporated herein by reference. If desired, center conductor 26 can be soldered to ferrule section 130. After coaxial cable 24 has been terminated to connector 10A, metal closure member 134 is force fit into recess 136 to seal the cavity containing the center conductor termination.

I claim:

1. A coaxial connector comprising:

a dielectric member having a bore extending therethrough;

a center contact member for disposition in said bore and for connection with a center conductor of a coaxial cable;

inner shell means hving a first section in which said dielectric member is positioned and a ferrule section on which an outer conductor of the coaxial cable is to be crimped;

spring contact means including a tubular section and spring contact section means, said tubular section extending about said first section of said inner shell means, said spring contact section means including leaf spring contact means extending parallel relative to the axis of the connector and leaf spring means bent back along respective ones of said leaf spring contact means;

outer shell means having a first member engaging said tubular section and a second member extending along said spring contact section means, a front end of said second member defining an entrance to said spring contact section means;

means between said first member and said tubular section securing said first member and said tubular section together; and crimping ferrule member means for crimping the outer conductor onto said ferrule section.

2. A coaxial connector as set forth in claim 1 wherein said ferrule section is coaxial with the axis of the connector and said center contact member is to be crimped onto the center conductor prior to being inserted into said bore.

3. A coaxial connector as set forth in claim 1 wherein said ferrule section extends at a right angle relative to the axis of the first section, said center contact member includes a conductor-receiving section in alignment with the axis of said ferrule section.

4. A coaxial connector as set forth in claim 1 wherein said leaf spring means are V-shaped and have tapered configurations.

5. A coaxial connector as set forth in claim 1 wherein said front end is rolled inwardly.

* * * * *